US010661288B2

(12) United States Patent
Patel et al.

(10) Patent No.: US 10,661,288 B2
(45) Date of Patent: May 26, 2020

(54) MANUALLY CONTROLLED VARIABLE COVERAGE HIGH RANGE ELECTROSTATIC SPRAYER

(71) Applicant: COUNCIL OF SCIENTIFIC & INDUSTRIAL RESEARCH, New Dehli (IN)

(72) Inventors: Manoj Kumar Patel, Chandigarh (IN); C Ghanshyam, Chandigarh (IN); Pawan Kapur, Chandigarh (IN)

( * ) Notice: Subject to any disclaimer, the term of this patent is extended or adjusted under 35 U.S.C. 154(b) by 479 days.

(21) Appl. No.: 15/522,082

(22) PCT Filed: Oct. 27, 2015

(86) PCT No.: PCT/IN2015/050146
§ 371 (c)(1),
(2) Date: Apr. 26, 2017

(87) PCT Pub. No.: WO2016/067310
PCT Pub. Date: May 6, 2016

(65) Prior Publication Data

US 2018/0281000 A1 Oct. 4, 2018

(30) Foreign Application Priority Data

Oct. 27, 2014 (IN) ..... 3045/DEL/2014

(51) Int. Cl.

| | |
|---|---|
| ***B05B 5/053*** | (2006.01) |
| ***B05B 7/04*** | (2006.01) |
| ***B05B 5/043*** | (2006.01) |
| ***B05B 5/03*** | (2006.01) |
| ***B05B 7/08*** | (2006.01) |

(Continued)

(52) U.S. Cl.
CPC ..... *B05B 5/0533* (2013.01); *B05B 5/03* (2013.01); *B05B 5/043* (2013.01); *B05B 7/045* (2013.01); *B05B 5/0426* (2013.01); *B05B 7/066* (2013.01); *B05B 7/083* (2013.01)

(58) Field of Classification Search
CPC ..... B05B 5/0533; B05B 5/03; B05B 5/043; B05B 5/0426; B05B 7/045; B05B 7/0815; B05B 7/066
USPC ..... 239/609, 609.1
See application file for complete search history.

(56) References Cited

U.S. PATENT DOCUMENTS 3,460,764 A * 8/1969 Wallis ..... B05B 5/03 239/422
3,630,441 A * 12/1971 Felici ..... B05B 5/04 239/692

(Continued)

FOREIGN PATENT DOCUMENTS

JP 08229445 10/1996
JP 2012040498 3/2012

(Continued)

*Primary Examiner* — Alex M Valis
*Assistant Examiner* — Joseph A Greenlund
(74) *Attorney, Agent, or Firm* — Hudak, Shunk & Farine Co. LPA

(57) ABSTRACT

The present invention discloses a single step process for the synthesis of furan derivative from carbohydrate comprises stirring the reaction mixture of carbohydrate in solvent in presence of catalyst at temperature in the range of 170 to 190° C. for the period in the range of 23 to 25 hrs to afford corresponding furan derivative.

5 Claims, 6 Drawing Sheets

(51) Int. Cl.
*B05B 7/06* (2006.01)
*B05B 5/04* (2006.01)

(56) References Cited

U.S. PATENT DOCUMENTS 3,635,401 A * 1/1972 Bromley ..... B05B 5/03 239/705
3,687,368 A * 8/1972 Geberth, Jr. ..... B05B 5/03 239/692
3,698,635 A * 10/1972 Sickles ..... B05B 5/03 239/3
3,767,115 A * 10/1973 Kozinski ..... B05B 5/0533 239/707
3,907,202 A * 9/1975 Binoche ..... B05B 5/03 239/705
3,937,401 A * 2/1976 Luderer ..... B05B 5/0533 239/707
3,952,951 A * 4/1976 Raetz ..... B05B 5/03 239/705
4,335,419 A * 6/1982 Hastings ..... B05B 5/043 239/690.1
4,355,764 A * 10/1982 Rood ..... B05B 5/035 239/600
4,572,438 A * 2/1986 Traylor ..... B05B 5/0536 239/600
4,664,315 A * 5/1987 Parmentar ..... B05B 5/043 239/402
5,229,171 A * 7/1993 Donovan ..... B05B 5/043 118/50.1
5,584,433 A * 12/1996 Nakagawa ..... B05B 7/0815 239/296
5,765,761 A * 6/1998 Law ..... B05B 5/03 239/690.1
5,944,045 A * 8/1999 Allen ..... B05B 5/1625 118/302
5,947,377 A * 9/1999 Hansinger ..... B05B 3/1042 239/3
6,003,794 A * 12/1999 Hartman ..... B05B 5/03 239/695
6,460,787 B1 * 10/2002 Hartle ..... B05B 12/0026 239/691
6,543,708 B1 * 4/2003 Stephenson, Jr. ..... B05B 5/047 239/691
6,866,212 B2 * 3/2005 Sumiyoshi ..... B05B 5/1691 239/332
7,056,387 B2 * 6/2006 van der Steur ..... B05B 15/55 118/629
7,070,130 B1 * 7/2006 Minko ..... B05B 5/0533 239/222.11
7,552,882 B2 * 6/2009 Matsumoto ..... B05B 5/0533 239/691
7,913,938 B2 * 3/2011 Cooper ..... B05B 5/03 239/690
8,016,213 B2 * 9/2011 Altenburger ..... B05B 5/0532 239/526
8,590,817 B2 * 11/2013 Baltz ..... B05B 5/0532 239/526
8,770,496 B2 * 7/2014 Altenburger ..... B05B 5/03 239/526
9,498,785 B2 * 11/2016 Sakurai ..... B05B 5/0533
9,901,942 B2 * 2/2018 Nolte ..... B05B 5/005
2005/0023369 A1 * 2/2005 Schaupp ..... B05B 5/04 239/3
2005/0074562 A1 * 4/2005 Minko ..... B05B 5/04 427/458
2005/0181142 A1 * 8/2005 Hirano ..... B05B 5/001 427/421.1
2006/0108436 A1 * 5/2006 Alexander ..... B05B 5/03 238/291
2006/0108451 A1 * 5/2006 Alexander ..... B05B 7/0815 239/526
2006/0144963 A1 * 7/2006 Fulkerson ..... B05B 5/032 239/433
2006/0175439 A1 * 8/2006 Steur ..... B05B 5/0407 239/703
2006/0219824 A1 * 10/2006 Alexander ..... B05B 5/0531 239/690
2007/0039546 A1 * 2/2007 Amari ..... B05B 5/03 118/629
2008/0006726 A1 * 1/2008 Ohno ..... B05B 5/03 239/706
2008/0121740 A1 * 5/2008 Yamada ..... B05B 5/04 239/703
2009/0140083 A1 * 6/2009 Seitz ..... B05B 5/0533 239/690.1
2010/0219268 A1 * 9/2010 Wurz ..... B05B 1/3405 239/590.5
2011/0271906 A1 * 11/2011 Yamada ..... B05B 5/0426 118/621
2012/0048196 A1 * 3/2012 Pravert ..... B05B 3/1064 118/712
2012/0240851 A1 * 9/2012 Murata ..... B05B 5/0535 118/663
2014/0110492 A1 * 4/2014 Cooper ..... B05B 7/0441 239/3
2015/0136022 A1 * 5/2015 Yamada ..... B05B 5/0407 118/626
2015/0140235 A1 * 5/2015 Meier ..... B05B 3/1014 427/600
2015/0251199 A1 * 9/2015 Mickols ..... B05B 5/0532 239/690
2016/0256878 A1 * 9/2016 Seitz ..... B05B 5/0532
2018/0141061 A1 * 5/2018 Ito ..... B05B 1/12
2018/0281000 A1 * 10/2018 Patel ..... B05B 5/03

FOREIGN PATENT DOCUMENTS

NL 6510410 8/1965
WO 8501894 5/1985

* cited by examiner

MANUALLY CONTROLLED VARIABLE COVERAGE HIGH RANGE ELECTROSTATIC SPRAYER

FIELD OF THE INVENTION

The present invention particularly relates to manually controlled variable coverage high range electrostatic sprayer in the field of electrostatic spraying nozzle for liquid spraying applications of the type having an externally air-assistive arrangement for the variable canopy coverage and high range spraying. The electrostatic spraying apparatus can be used in the presence of high wind and harsh environmental conditions. This device has the utility/applications in the field of agriculture for spraying pesticides for crops and orchards with enhanced level of performance and bio-efficacy of biological surfaces.

BACKGROUND OF THE INVENTION

The electrostatic spraying apparatus of the type having an externally air-assistive arrangement, designed for several improved parameters such as variable canopy coverage, high range target distance, applicable in transient and harsh agro-climatic conditions i.e. the presence of high wind, incorporated in the body of the sprayer, may increase the bio-efficacy.

Although, organic measures for crop protection are being preferred, chemical intervention is still the fastest and most economical way for crop protection. However, due to lack of awareness and ignorance, pesticides are being used indiscriminately leading to side effects on human health and ecosystem. Electrostatic method of pesticide application reduces off-target drift, environmental pollution and human health risks and increases the bio-efficacy and mass transfer efficiency onto the biological surfaces of crops and orchards with back deposition uniformly. So far, the equipment available in the market are uncontrolled in terms of spraying variability. Application of pesticide control, targeted pesticide delivery and variable pesticide spraying are the key to improve operation quality, reduce chemical waste, environmental pollution and low operational costs.

Electrostatic force field application to agricultural pesticide spraying is well known, it was discovered in late 1980s, references may be made to U.S. Pat. Nos. 3,630,441 and 3,698,635 A, wherein an electrostatic spraying apparatus has been developed for spraying. Although the electric charge associated with the liquid droplets was Known from the 19th century, but the actual application of electrostatic to agriculture came into existence at the end of the 19th century. A review of prior art, electrostatic process can be found in Electrostatics and its Applications, Moore, A. D., Ed., Wiley and Sons, 1973. Recently U.S. Pat. No. 7,913,938 B2 granted to Steven C. Cooper was electrostatic spray nozzle with adjustable fluid tip and interchangeable components. Numerous electrostatic nozzle patents have been granted, references may be made to U.S. Pat. Nos. 6,003,794; 6,276,617; 6,138,922 and 6,227,466, use an induction charging principle and liquid tip and air channel geometry that are similar to the above mentioned patents by Law, Cooper and Sickles. Other related work in the field of spraying may be referenced as patent numbers U.S. Pat. Nos. 5,765,761; 5,052,628; and 4,664,315, wherein the same principle has been used for the charging purposes in spraying system.

The electrostatic sprayers available and marketed so far, are being used in agriculture but the problem associated with these kind of sprayers are; directionality, variability in canopy coverage, target distance, and incapable of spraying in the presence of high wind, harsh and transient environment. Thus there is a need to provide a solution to the spray drift problem by simple mechanical means. In the existing nozzles, once the cone angle (swath width) of spraying is fixed according to the set of requirements during the design of the nozzle (diameter of the nozzle tip, flow rate etc.), the spray canopy coverage i.e. canopy covered by the spray cannot be altered further, unless the new design comes. There is not a possibility of narrowing or broadening the spray pattern during the operation of the nozzle. All nozzle tips produce a range of droplet sizes with low-drift reducing the number of small droplets. Droplets less than 100 microns are most susceptible to spray particle drift. In the case of electrostatic spraying the droplet size is in the order of less than 100 microns. The smaller droplets are more prone to drift from the target. The electrostatic repulsion among droplets is also the cause of spray drift. Presence of high wind is another cause of spray drift and presently available sprayers have no arrangement which can be used in even in normal wind. In this invention a manually controlled variable coverage high range external air-assisted electrostatic sprayer system has been developed to guide the fine droplets with the help of externally supplied high pressurized air. External air supply improves the aerodynamics conditions between spray exit from the nozzle tip and the actual target to be sprayed. The sprayer may increase the efficiency and bio-efficacy of the biological surface and reduces the air and soil pollutions.

OBJECTS OF THE INVENTION (i) The main object of the present invention is to provide a method for spraying the liquid efficiently.

(ii) Another object of the present invention is to provide a method for improved transport of the charged droplets to intended target.

(iii) Yet another object of the present invention is to provide appropriate aerodynamic conditions to transport the finely divided particulate matter.

(iv) Yet another object of the invention is to provide an external air-assistance to charged droplets, even if the high wind is present.

(v) Yet another object of the invention is to provide a manual control to adjust the target spray coverage according to the canopy surface.

(vi) Yet another object of the invention is to provide an external air-assistive device for high range spraying.

(vii) Yet another object of the invention is to provide variable external air supply for variable distance coverage.

(viii) Still another object of the invention is to provide an automated switching (ON/OFF) of the power supply to the spray charging electrode.

(ix) Yet another object of the invention is to provide a sequence of the input supplies to the nozzle system.

SUMMARY OF THE INVENTION

Electrostatic spraying can majorly be divided into three sections: (a) Hydrodynamics, (b) Electrodynamics and (c) Aerodynamics. Once the fine droplets formed and charged to a sufficiently and significant net electrical charge, electrostatic forces which mainly decide the trajectory of charged particle, is the main consideration is aerodynamic activity in electrostatic spraying, including other minor, undesired, and unwanted forces. The conversion of the liquid stream into droplets takes place at the droplet formation zone which is inside the hollow passage of a housing made of an electrically insulating material. The high velocity airstream is the main kinetic energy source, for the atomization and thrust provided to finely divide particulate matter, against frictional force and air resistance in open environment. The size of the droplets in electrostatic spraying is in the order of few microns. Since the smaller droplets are more prone to drift from the target, can be assisted from external support of the compressed air, which form a virtual guiding media for the drift prone droplets, increases the nozzle efficiency and bio-efficacy, and will cover a longer distance of the target canopy, and applicable in the transient and harsh agro-climatic conditions i.e. in the presence of high wind.

The present invention provides an improved transport of the charged droplets to intended target. In this invention, a variable canopy coverage spraying system is designed and developed. The designed system provides a means to spray the liquid more effectively, more coverage distance, reduces off-target losses and applicable in harsh atmosphere such as in the presence of high wind.

Accordingly the present invention provides manually controlled variable coverage high range electrostatic sprayers which comprises an external air-assistive unit to provide the virtual path for the charged droplets (i), electrostatic nozzle (ii), a pipe connecting the electrostatic nozzle and nozzle holder having the high voltage power supply and controlling circuitry (iii), trigger unit along with locking system (iv), automated switching (ON/OFF) device for high voltage power supply system (v), dc-to-dc converter for high voltage power generation (vi), rechargeable dc battery (vii), display system (viii), numerical voltage display of the rechargeable dc battery through display unit (ix), external compressed air supply controlling unit for variable air supply (x), conductive liquid supply pipe connector with filter (xi) and compressed air supply pipe connector with air filter (xii), respectively.

The embodiments of the novel invention in which an exclusive properly or privilege is claimed are defined as follows:

An air-assisted electrostatic spraying system being configured along with an external air assistance to provide an improved condition to charged droplets, wherein the said device comprises:

A liquid delivery pipe of non-conducting material for delivering a liquid to the spray nozzle; connected to conductive material connector maintained at ground potential; connected to the liquid supply system.

Delivery of compressed air to the spray nozzle via the air delivery tube, connected to compressed air supply system.

A chamber for mixing the liquid and compressed air; coming for the liquid and compressed air supply pipe; maintained at a selected high potential; to form the fine small droplets.

Nozzle housing made of electrical insulating material having the said passage for the air and liquid supply, front end having ring electrode coaxially from the nozzle tip for spray charging separated along with ground electrode.

A said ring electrode made of a conductive material embedded within the insulating nozzle housing coaxially with front end of the conductive liquid exit tip of the nozzle, said material electrode spaced a defined and selected distance from the nozzle tip and ground electrode.

The said ground electrode and charging ring electrode are spaced coaxially.

An external air-assistance system spaced coaxially with exit spray, surrounding the charged droplets to provide favorable conditions to finely divided particulate matter by forming the virtual path around the spray along with a manual control to elongate or compress the said external air-assisted system for adjusting the spray cone angle.

An automated switching device to switch (ON/OFF) the power supply automatically via detecting the liquid flow stream in said nozzle system in-house with the power supply unit, raised to several kilovolts from a dc rechargeable battery, the said rechargeable battery is easily replaceable.

The said voltage level of rechargeable dc battery has an arrangement to display the voltage level through display unit.

Manually controlled external air-assistive unit along with the trigger and locking system according to the said requirement of the variable spray cone angle of the canopy to cover and said distance of the target.

Manual control of external air supply to control the flow and amount of the air supplied to external assistive device according to the optimized ratio of air and said spray pattern of the droplets, to achieve the variable target distance.

DETAILED DESCRIPTION OF THE INVENTION

Figure 1:
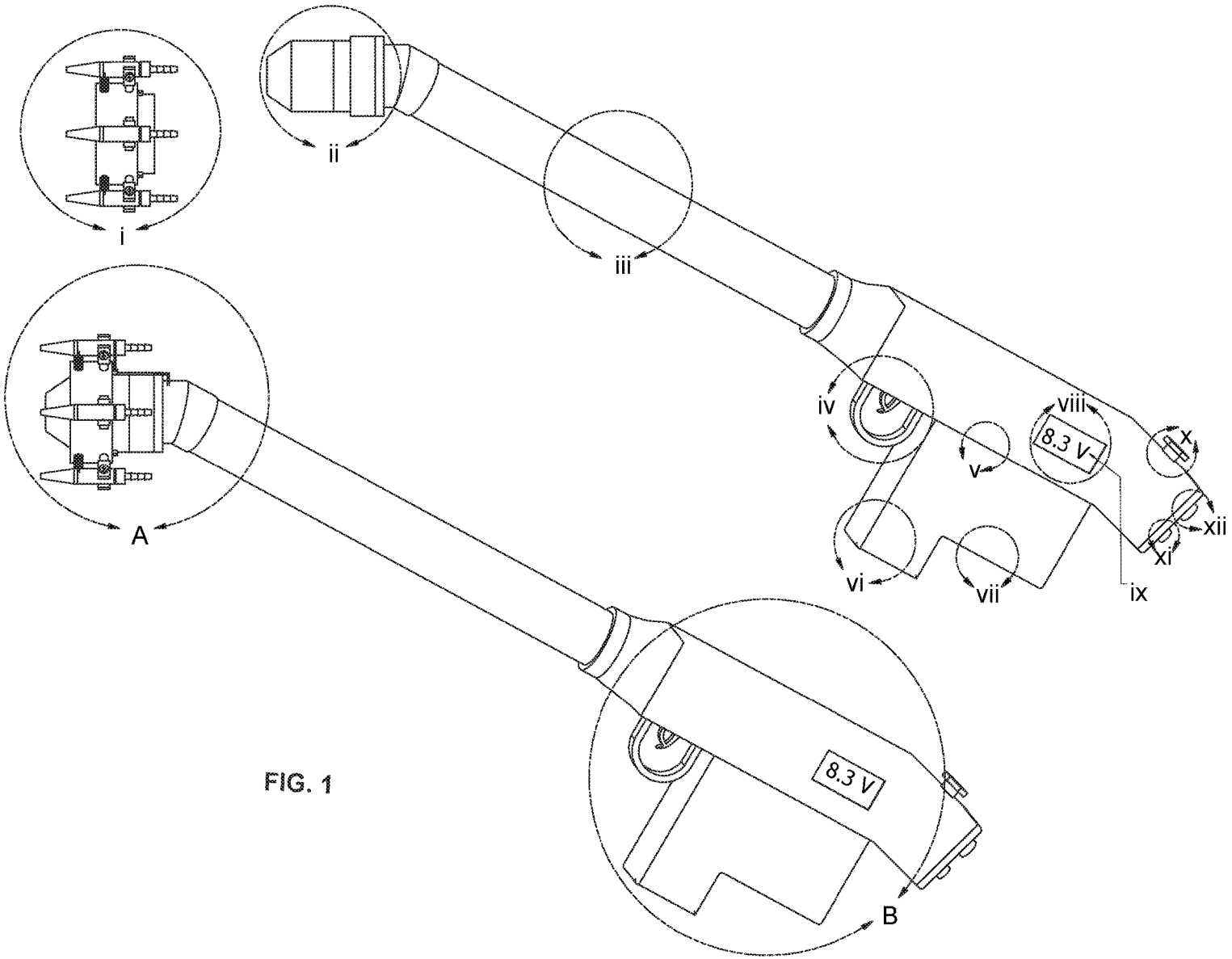
FIG. 1 represents a complete manually controlled variable coverage high range electrostatic sprayer, a combination of external air-assistive unit to provide the virtual path for the charged droplets (i), electrostatic nozzle (ii), a pipe (iii) connecting the electrostatic nozzle (A) and nozzle holder (B) having the high voltage power supply and controlling circuitry, trigger unit along with locking system (iv), automated switching (ON/OFF) device for high voltage power supply system (v), dc-dc converter for high voltage power conversion (vi), rechargeable dc battery (vii), display system (viii), numerical voltage display of the rechargeable dc battery through display unit (ix), external compressed air supply controlling unit for variable air supply (x), conductive liquid supply pipe connector with filter (xi) and compressed air supply pipe connector with air filter (xii) respectively.

Referring to FIG. 1, the whole nozzle is divided in two parts, named as electrostatic nozzle (A) and the nozzle holder (B). An embodiment of the manually controlled variable coverage high range electrostatic sprayer of the present invention is illustrated and the complete embodiment is marked i, ii, iii, iv, v, vi, vii, viii, ix, x, xi and xii as separate units for the better understanding of the present invention. Each unit has its importance and contributing to the present invention. These units are named as external air-assistive unit to provide the virtual path for the charged droplets (i), electrostatic nozzle (ii), a pipe connecting the electrostatic nozzle and nozzle holder having a high voltage power supply system having the controlling circuitry (iii), trigger unit along with locking system (iv), automated switching (ON/OFF) device for high voltage power supply system (v), dc-to-dc converter for high voltage power conversion (vi), rechargeable dc battery (vii), display system (viii), numerical voltage display of the rechargeable dc battery through display unit (ix), external compressed air supply controlling unit for variable air supply (x), conductive liquid supply pipe connector with filter (xi) and compressed air supply pipe connector with air filter (xii), respectively.

In electrostatic spraying, the droplets size is in the order of microns and droplets are more prone to drift and volatile. Although the electrostatic forces are helping the charged droplets to reach the target in aerodynamic region, which is the major advantage of the electrostatic spraying technique; but still the possibility of droplets off-target drift because of small droplets and transient agronomic conditions such as presence of high wind in the atmosphere. The commercially available spraying equipment's have no features which are applicable in such kind of harsh environment especially in the presence of the high speed wind.

Figure 2:
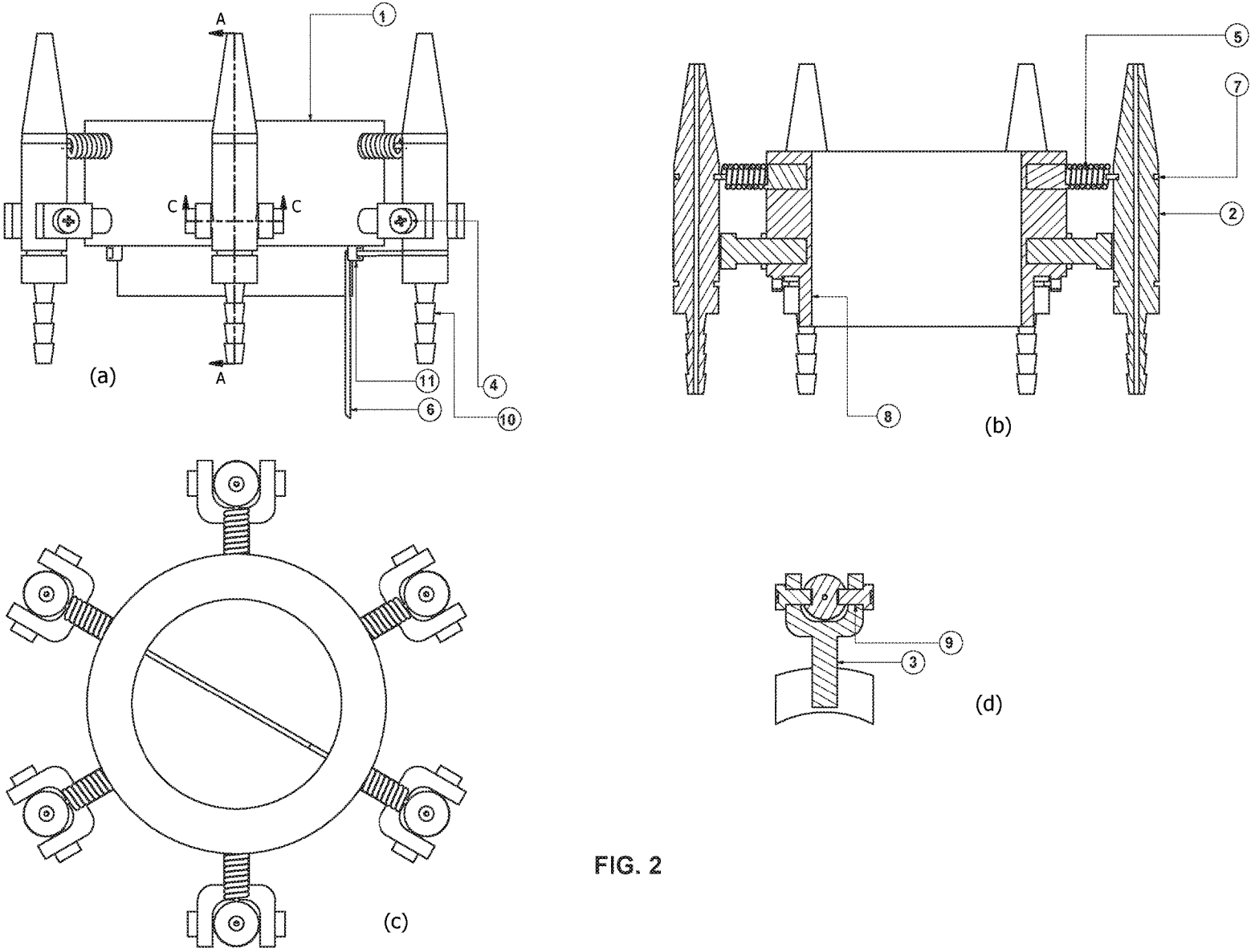
FIG. 2 represents a manually controlled air-assistive system to provide a suitable path to charged droplets to reach the intended target, even in the presence of high wind. This unit has external air supply (may vary in number), coverage area control with the help of spring system, for the variable spray, variation of spray angle is from parallel to the spray center line (natural condition of spring system) to maximum spray cone angle (at maximum elongation of the spring system) that is equivalent to nozzle cone angle. There is an air supply control unit which is having a knob to control the external air supply into the external air-assistive arrangement.
Figure 3:
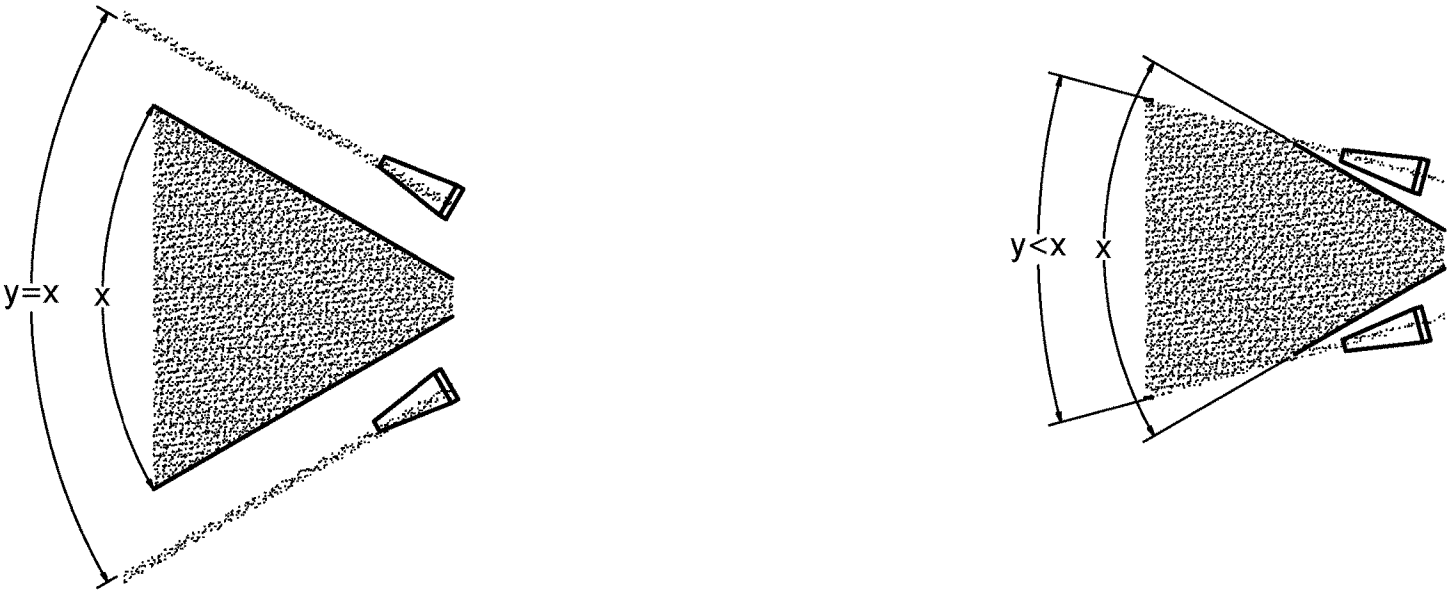
FIG. 3 shows a variation of the target spray coverage from maximum to minimum. It is a virtual air envelop formed around the charged spray. It is an imaginary path and it may vary with the supplied air pressure and flow.

Referring to FIG. 2, the external air-assistive unit (i) may help in such cases to avoid the off-target losses more effectively and increases the bio-efficacy. The external air assistive unit (i) forms a virtual path for the finely divided particulate charged matter to provide the aerodynamic conditions for the transport of droplets to the intended target. Initially when trigger 34 is in its rest position there will be no force applied on connecting cord 6 and hence spring will be in its relaxed position, as a result air pipes 2 will be in horizontal position i.e. y=0 as shown in FIG. 3(*c*). In this position of the external air-assistive compressed air-supply pipes 2 (y=0), alters the target coverage area by forming high pressure air envelop around this spray, thus providing a virtual path of flow of finely divided particulate droplets in the aerodynamic region. Due to the air envelope formed around the electrostatic spray cone, providing a minimum coverage area at the end. To increase this coverage area, externally manual force is applied on the trigger 34, due to which cord 6 will come in tension and pull the spring 5 so air supply metallic pipes 2 positions will change from minimum to maximum gradually. The position can be fixed in between minimum to maximum coverage as shown in FIG. 3(*b*), depending on the applications and target coverage area to be sprayed. Coverage area of liquid droplets is decided by the envelope formed by high pressure air passing through air supply metallic pipes, thus maximum coverage area will be achieved as shown in FIG. 3(*a*). Therefore by applying manual force through trigger, the position will be altered for air supply metallic pipes and will get variable coverage area of charged liquid droplets. This spray pattern also provide safety from adverse atmospheric condition like wind flow. As Atmospheric wind flowing around will have to interact to high pressure air envelope of 50 psi to 200 psi formed around liquid droplets rather coming in direct contact in absence of air assisting unit. Thus the effect of atmospheric wind on the path followed by liquid droplets will be reduced.

The primary base body 1 made of insulating material, comprising the six compressed air supply i.e. metallic pipes 2 which are free to move in angular direction along with the constraints from minimum to maximum possible spray target coverage as shown in FIG. 3, connected to external air supply 10. The spray coverage varies from minimum target coverage (c) to maximum target coverage (a) along with one view of middle spray coverage (b). For minimum target coverage the springs are in relaxed position. For maximum target coverage the springs are in maximum possible elongation and the supporting external air assistive path is in parallel to spray coverage. The air supply pipes may vary in number. The numbers may be four, six, eight or many depends on the requirement of the spraying applications. These pipes 2 are angularly movable in a U shaped supporting metallic structure 3 fixed in an insulating base body 1. The pipes are lightened with the help of screw 4 which is half threaded 9 and half smoothed, the smooth portion of the screw is inside the metallic pipes to hold. The compressed air supply pipes 2 are angularly movable through springs 5 which are connected to front part of the pipes 2 in a grooved portion 7. To provide maximum force for angular motion to the pipes 2, the cords 6 are connected to the rear end of the air pipes 2, which pass through the vertical holes 11. These cords manually pulled with trigger unit (iv) as shown in FIG. 1. All these cords put together in one cord attached with an electrostatic nozzle (ii) and finally connected to the trigger unit (iv). The base body 1 is connected through inner threads 8 with the outer thread of the electrostatic nozzle body 16. The externally air-assistive part (i) is detachable whenever is required from the electrostatic nozzle (ii).

Figure 4:
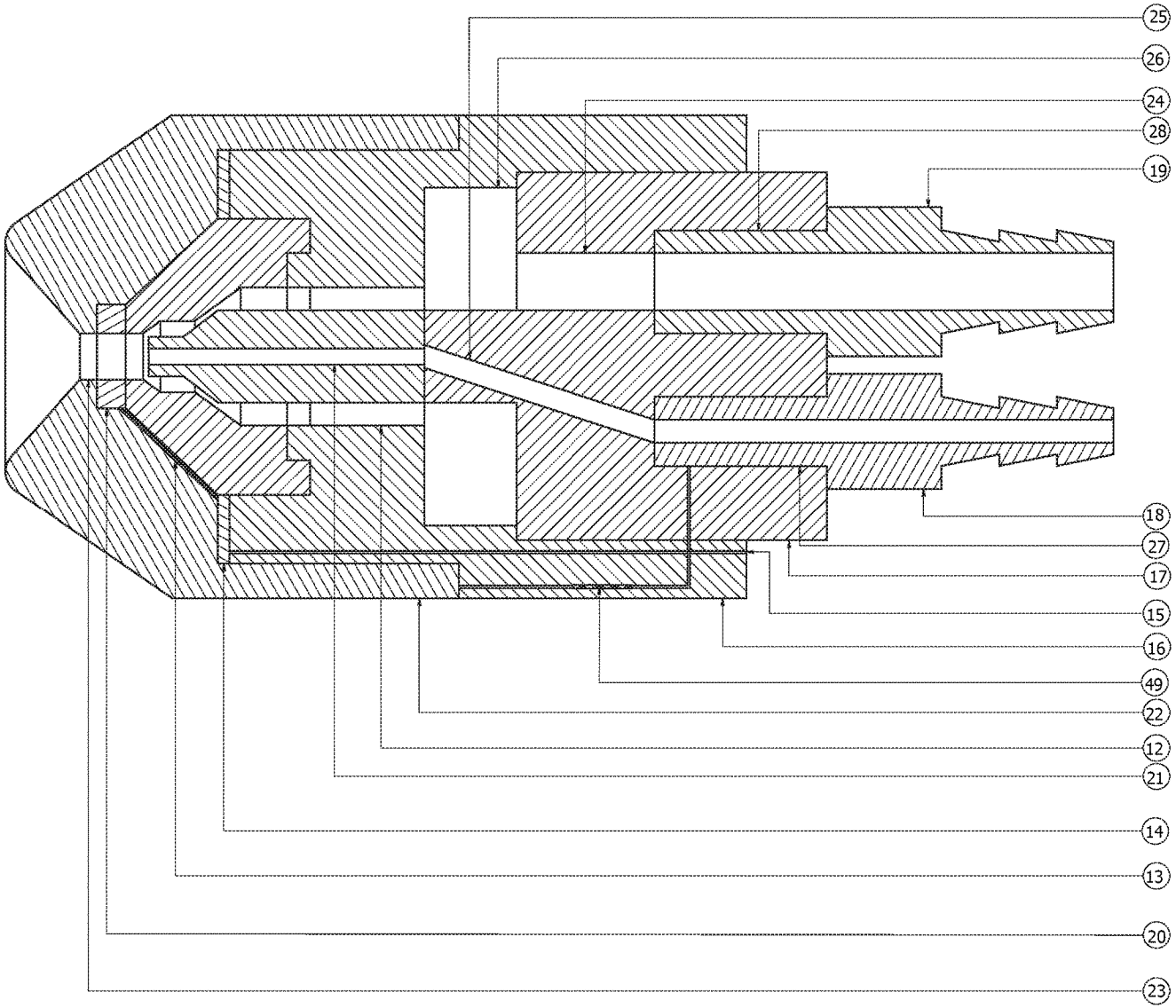
FIG. 4 represents an induction based air assisted electrostatic spraying nozzle, having the non-conducting pipe connected to conductive connect to liquid filter for conductive liquid supply, a compressed air supply pipe, a chamber for mixing the air and conductive liquid to form the fine small droplets, a ring electrode for charging the spray embedded in the nozzle body.

Referring to FIG. 4 of electrostatic nozzle is broadly consisting of three nozzle parts named as electrode cap 22, nozzle body 16 and conductive liquid and air pipe connector 17. First part, the main nozzle body 16 made of insulating material having conductive liquid passage 21 in the center of nozzle surrounded coaxially by four extendable equidistant air passages 12. The charging electrode 20 connected to a high voltage connecting wire 13 which is connecting to metallic thin disc 14. The disc 14 is connected with high voltage wire 15 to high voltage power supply system. Second assembled part is electrode cap 22 which secures electrode 20 at its position which is at specific distance from the nozzle tip of conductive liquid passage pipe 21. Electrode cap 22 is having a passage 23, conical at tip extended cylindrically to the end at its center which provides the way of exit to the droplets generated from the interaction of conductive liquid and compressed air. Third assembled body is conductive liquid and compressed air pipe connector 17, which consists of metallic conductive liquid connector 25 and air connector 24, opens in cavity formed while assembling liquid and air pipe connector body 17 and the main nozzle body 16. The metallic conductive liquid connector 18 and air supply connectors 19 connected through the threaded part of the liquid connector 27 and the air connector 28. Electrode cap 22 will be assembled through the inner threads to outer threads of the main nozzle body 16. The main nozzle body 16 assembled through inner threads to the outer threads of liquid and air pipe connector 17. An arrangement of dissipating the stray current is shown via a very high resistance 49 to avoid the shock and hazards.

Figure 5:
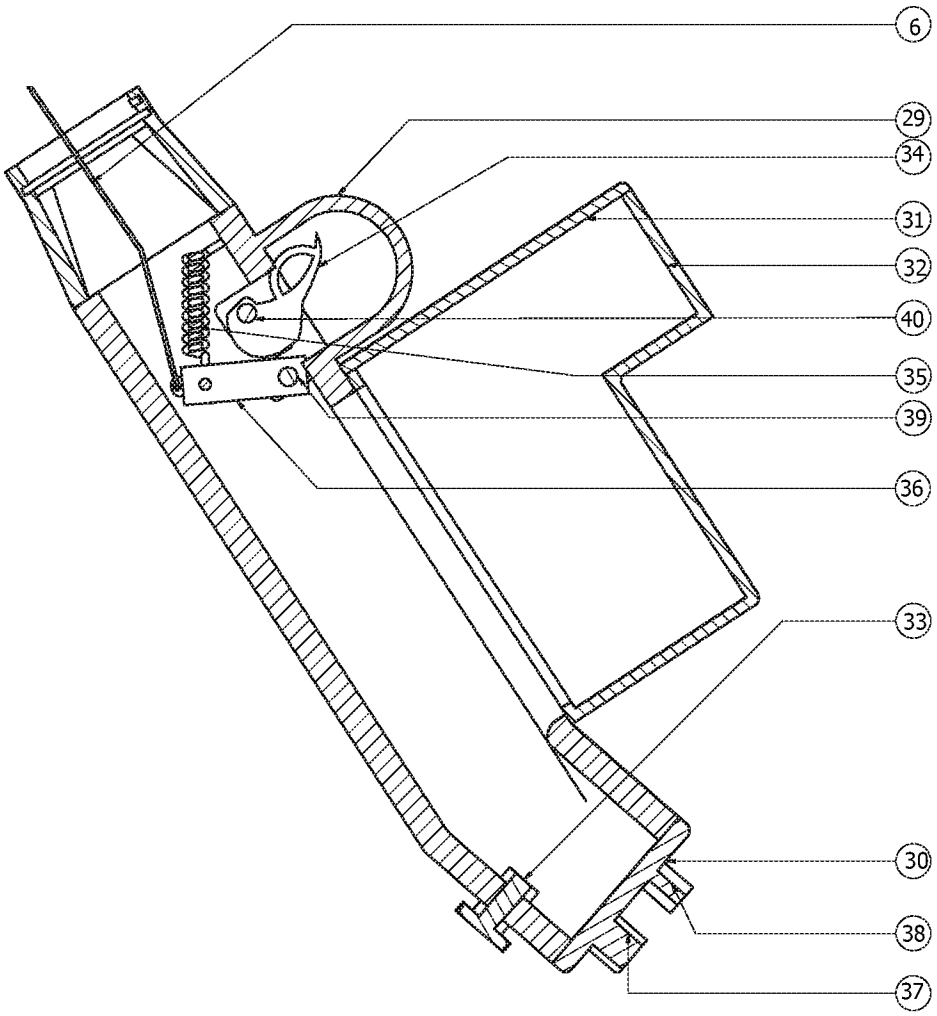
FIG. 5 represents a controlling unit having a trigger and spring system, along with the locking facility, to compress or elongate the spring system to provide the variable the air supply. This unit is a combination of trigger and spring system.

Referring to FIG. 5, the holder of the nozzle includes manual controller unit (iv) for external air-assistive device. The manual controller unit (iv) consists of a trigger 34, hinged by screw 40, gives angular motion to lever 36 on rotation of the trigger hinged by screw 39. The trigger 34 is supported by a holding unit 29. Thus cord 6 will move with lever 36 due to tension when trigger 34 is moved to left side. When trigger 34 will be left then lever 36 and cord 6 will come to its original position due to force exert by spring 35. Thus angular motion of the pipes 2 of external air assisted nozzle is controlled by this manual control unit through the to and from motion of cord 6.

Units (vi) and (vii) of FIG. 1 contain power supply system along with rechargeable dc battery. The dc voltage level has been raised to several kilovolts through a dc-to-dc converter and fed up to the charging ring electrode 20 for the charging of the finely divided particulate matter.

Figure 6:
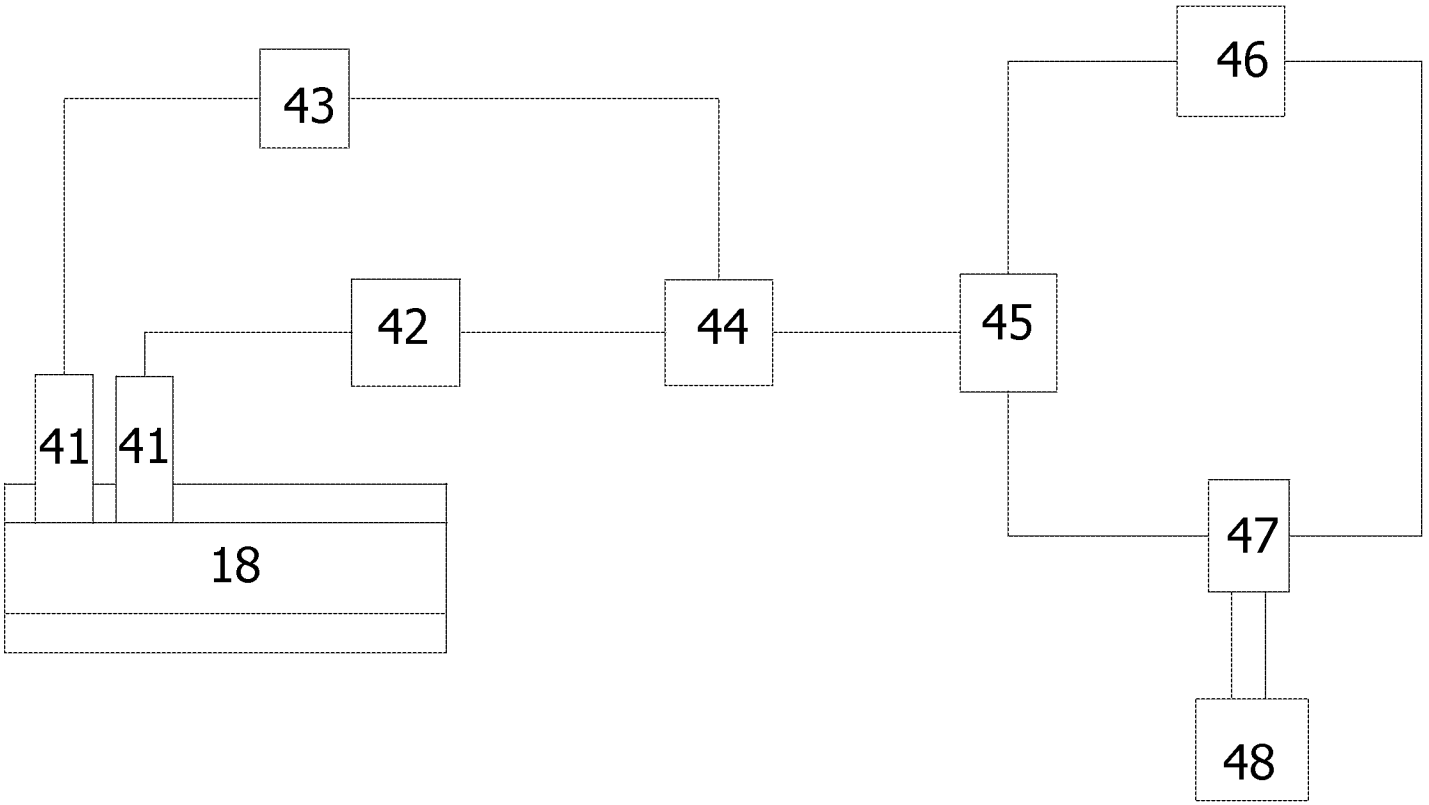
FIG. 6 represents an automated switching (ON/OFF) device for the high voltage power supply via detecting the flow of liquid, to control the sequence of different supplies i.e. compressed air supply, liquid supply and high voltage power supply to the nozzle system.

Referring to FIG. 6, an automated switching circuit (v) for switching (ON/OFF) the power supply system consists of two stainless steel probes 41 of selected dimensions. When the conductive liquid is detected by the stainless steel probes 41 inserted into the insulating liquid pipe 18 inside the nozzle (ii), gives a weak voltage signal as output and this signal is then fed to the base of the transistor 42 and the signal is amplified and the output from the collector of the transistor is further fed to the current amplifier 44 for current amplification of the signal. The driving power for the transistor and current amplifier is supplied by the dc battery 43. The current amplifier is important as it provides the necessary current to drive the relay 45. The dc-to-dc converter is driven with the help of a relay circuit 45, which acts as a switch and helps in the completion of the circuitry to drive the converter. The current amplifier 44 provides the sufficient power to drives the relay 45 and helps to switch the voltage source, i.e. do replaceable battery 46 and hence dc-to-dc converter 47. Finally the high voltage supply is fed to the charging electrode for spray charging through high voltage connector 48.

The units (viii) and (ix) of FIG. 1 consist the display unit. At the time of spraying, as the time passes, the rechargeable dc battery gets discharged. The level of the battery potential is displayed by a display unit with the help of multi-meter in numeric form.

The unit (x) of FIG. 1 is the air flow control unit which maintains the required air flow rate for external air-assistive device, according to the requirement of target distance and spray coverage. Manual control knob 33 of air flow control unit can control the change of the air flow by rotational movement.

The back side of the holder has two supply units (xi) and (xii), the conductive liquid supply pipe and air supply pipe. The liquid pipe connected to the liquid filter 38 to avoid passing the contaminants through the pipe. The compressed air supply pipe is connected to the air filter 37. These two pipes pass through the nozzle holder B and connecting to the nozzle body (ii).

The novelty of the present invention/device lies in the presence of an external air assistance system which uses variation in air pressure to vary the air shroud and hence helps in varying the spray cone angle and changing the canopy coverage range and area. The present device focuses on shielding the fine electrostatic spray from these harsh wind conditions. This invention uses concentric movable metallic nozzles to vary the spray cone angle, the range as well as coverage of the electrostatic spray. Such variation has been achieved by simple mechanical means so as to make the device least complicated in operation. The mechanism used to control the metallic nozzles is a cam operated trigger mechanism. It utilizes spring and cord arrangement to achieve the angular movement of the air nozzles. The external air assistance forms a virtual envelop around the charged particulate matter in the aerodynamic region of charged spray to protect the neutralization from naturally occurring radioactive phenomena. It provides variable spray coverage with the adjustment according to the requirement of canopy and target and applicable in the presence of high wind and harsh environment. It covers a longer coverage distance of the crops specially in orchard spraying with enhanced performance and bio-efficacy.

The following examples are given by way of illustration of the working of the invention in actual practice and should not be construed to limit the scope of the present invention in anyway.

Example-1

A system for electrostatic spraying of liquids such as agricultural pesticides combines a pneumatic atomizing nozzle with electrostatic induction charging system. The finely divided droplets passes through the ring electrode placed coaxially at a distance of 2.5 mm from the nozzle tip. The droplets are charged significantly and exit from the nozzle with net negatively charge. The voltage has been supplied from the high voltage power supply system, which is generated from the dc rechargeable battery with the help of dc-to-dc convertor raised to several kilovolts level.

Once the charged droplets come out of the nozzle in aerodynamic region, the try to repel and make a fountain like path. Since the droplets size are in the range of 30-75 micron and this droplet size is more susceptible and prone to off-target drift. The external air assistive unit forms a virtual path for the finely divided particulate charged matter to provide the aerodynamic conditions for the transport of droplets to the intended target. Initially when trigger is in its rest position there will be no force applied on connecting cord so spring will be in its relax position, as result, air pipe will be in horizontal position i.e. y=0 as shown in FIG. 3(*c*). In this position of the external air-assistive compressed air-supply pipes (y=0), external air supply alters the target coverage area by forming high pressure air envelop around this spray, thus providing a virtual path of flow of finely divided particulate droplets in the aerodynamic region. Due to the air envelope formed around the electrostatic spray cone, providing a minimum coverage area at the end. To increase this coverage area, externally manual force is applied on the trigger, due to which cord will come in tension and pull the spring 5 so air supply metallic pipe position will change from minimum to maximum gradually. The position can be fixed in between minimum to maximum coverage as shown in FIG. 3(*b*), depending on the applications and target coverage area to be sprayed. Coverage area of liquid droplets is decided by the envelope formed by high pressure air passing through air supply metallic pipes, thus maximum coverage area will be achieved as shown in FIG. 3(*a*). Therefore by applying manual force through trigger, the position will be altered for air supply metallic pipes and will get variable coverage area of charged liquid droplets. This spray pattern also provide safety from adverse atmospheric condition like wind flow. As Atmospheric wind flowing around will have to interact to high pressure air envelope formed around liquid droplets rather coming in direct contact in absence of air assisting unit. Thus the effect of atmospheric wind on the path followed by liquid droplets will be reduced.

Example-2

An electrostatic nozzle assembly for coating row crops and other plants with electrostatically charged particles of pesticide including a nozzle body formed with passageways to receive air and grounded stream of waterborne pesticide for delivery through a nozzle tip to an inductor ring embedded in the nozzle cap. The inductor ring inductively charges the pesticide droplets. These negatively charged droplets are guided by the virtual envelop made by the external air-assistive unit which supplies compressed air in the aerodynamic region. The droplets are guided longer distance depending on the external air supply. The spring system provides the variable coverage path according to the canopy coverage. Manually controlled variable coverage high range electrostatic sprayer is applicable in transient and high wind agro-climatic conditions, reduces the air and soil pollutions.

ADVANTAGES

The main advantages of the present invention are:

1. Will provide variable spray coverage with the adjustment according to the requirement of canopy and target.
2. Will be applicable in the presence of high wind and harsh environment.
3. Will cover a longer coverage distance of the crops specially in orchard spraying.
4. Will increase the bio-efficacy of the biological surfaces of crops and orchards.

CONCLUSION

1. An air-assisted electrostatic spraying system with external air assistance, wherein the said device comprises of: an external air assistive unit to. provide virtual path for the charged droplets (i), connected to an electrostatic nozzle (ii), forms an external air assisted electrostatic nozzle (A) which is further connected to a nozzle holder (B) through a pipe (HI) which consists of a high voltage power supply and controlling circuitry through a pipe.

2. The device of 1, wherein the said nozzle holder comprises of a trigger unit along with locking system (iv), automated switching (ON/OFF) device for high voltage power supply system (v), dc-to-dc converter for high voltage power generation of 1.5 kV to 2.5 kV (vi), rechargeable dc battery (vii), display system (viii), numerical voltage display of the rechargeable dc battery through display unit (ix), external compressed air supply controlling unit for variable air supply with air filter (x), conductive liquid supply pipe connector with filter (xi) and compressed air supply pipe connector with air filler (xii), being embedded in a nozzle housing made up of an insulating material having an arrangement of dissipating the stray current via a very high resistance to avoid the shock and hazards and the spray cloud current around the electrode placing, generates stray current which is dissipated through a very high resistance in the range of few Giga ohms connected in the conductive material nozzle body near the charging ring electrode.

3. The device of claim 1, wherein the said external air assistive unit (i) forms a virtual path for the finely divided charged particulate matter to provide the aerodynamic conditions for the transport of droplets to the intended target!

4. The device of 1, wherein manual control of external air supply of 50 psi to 200 psi has been provided to control the flow and amount of the air supplied to external assistive device according to. the optimized ratio of air and said spray pattern of the droplets, to achieve the variable target distance.

5. The device of 1, wherein the said electrostatic nozzle comprises of an external air assistive arrangement having six coaxial air passages (the number of the said air passages being variable) coaxially equidistant from the front end of nozzle exit tip made of tough material to withstand the pressure and thrust of compressed air supply wherein the said metallic air passages are movable and supported with the help of the fixed metallic U shaped structure.

6. The device of 5, wherein a spring and cord system is provided for the variable adjustment of spray from minimum to maximum target canopy coverage is connected to the metallic air passages for the manual control of angular movement of the said air passages.

7. The device of 2, wherein the automated switching (ON/OFF) device for high voltage power supply system (v) comprises of: two conductive material pin type electrodes for sensing the liquid flow of the of defined and selected dimensions, diameter of 1 mm and length 5 mm, inserted into the non conductive liquid pipe inside the nozzle at a selected distance from the said spray charging ring electrode, an electronic circuit to amplify the detected liquid flow in terms of current output and fetching the said current output to a current amplifier which drives the relay unit and the said relay unit triggers the said power supply unit through dc rechargeable battery.

8. The device of 2, wherein the said ring electrode is made of a conductive material Nickel having 4 mm inner diameter and 14 mm outer diameter embedded within the insulating nozzle housing, coaxially with front end of the conductive liquid exit tip of the nozzle, said material electrode spaced at defined and selected distance from the nozzle tip and ground electrode.

9. The device of 2, wherein a manually controlled trigger and locking system has been provided according to the said requirements of the variable spray cone angle of the canopy to cover and said distance of the target.

10, The device of 3, wherein the air stream forms an inner stream around the said ring electrode, that is, a means between the liquid jet and the said ring electrode to avoid the breakdown of the said ring electrode due to wetting effect.

11. The device of 2, wherein the high resistance is in the range of few Giga ohms, maintained to a zero potential through a grounded liquid.

We claim:

1. A variable coverage high range air-assisted electrostatic spraying system with having an external air-assistive unit, comprising:

the external air-assistive system comprising charged droplets and a virtual path for the charged droplets, the air assisted system connected to an electrostatic nozzle, and forming an external air-assisted electrostatic nozzle (A), the electrostatic nozzle further connected to a nozzle holder (B) that comprises a voltage power supply and a controlled electronic circuitry; wherein the external air-assistive system comprises coaxial air supply metallic pipes, that are free to move in an angular direction, placed coaxially equidistant from a front end of a nozzle exit tip, made of material to withstand a pressure and a thrust of a compressed air supply wherein the metallic air supply pipes are movable in a metallic U-shaped structure, and including a spring and cord system for a manual adjustment of a spray from a minimum to a maximum coverage, the spring and cord system being connected to the metallic air supply pipes for the manual control of angular movement of the supply pipes, and including a trigger, said trigger operatively connected to the spring and to the cord.

2. The spraying system as claimed in claim 1, wherein the nozzle holder comprises a trigger unit, a screw and a lever, a locking system, an automated switching circuit, a high voltage power supply system, a dc-to-dc converter for high voltage power generation, a rechargeable dc battery, and a display system; an external compressed air supply system, comprising an air filter, a conductive liquid supply pipe connector having a filter and a compressed air supply pipe connector having an air filter, the compressed air supply system located in a nozzle housing.

3. The spraying system as claimed in claim 2, wherein the automated switching circuit for a voltage power supply system comprises two conductive electrodes for detecting a fluid in the liquid supply pipe connector, a plurality of voltage sources, a circuit amplifier for amplifying the detected liquid fluid, and the current amplifier providing power to a relay for switching the voltage source of the dc rechargeable battery.

4. The spraying system as claimed in claim 2, wherein said charging ring electrode is made of a conductive nickel having a 4 mm inner diameter and a 14 mm outer diameter.

5. The spraying system as claimed in claim 1, wherein manual control of the external air supply system having a pressure of 3 bar to 4 bar forms a high pressure air envelope around the charged droplets, and reduces the effect of any atmospheric wind on the path of the liquid droplets.

* * * * *